US005702101A

United States Patent [19]

Russell

[11] Patent Number: 5,702,101

[45] Date of Patent: Dec. 30, 1997

[54] HANDHELD GAMING BALL DISPLAY DEVICE

[76] Inventor: Douglas R. Russell, 2502 Woodside Dr., Louisville, Ky. 40207

[21] Appl. No.: 781,904

[22] Filed: Dec. 30, 1996

[51] Int. Cl.[6] ..... A63F 3/06

[52] U.S. Cl. ..... 273/144 B

[58] Field of Search ..... 273/144 B, 144 A, 273/144 R

[56] References Cited

U.S. PATENT DOCUMENTS

| | | | |
|---|---|---|---|
| 3,423,872 | 1/1969 | Dodson | 273/144 B |
| 3,468,542 | 9/1969 | Ernst | 273/144 A |
| 3,679,208 | 7/1972 | Carrano et al. | 273/144 R |
| 4,280,702 | 7/1981 | Tremblay | 273/144 B |
| 4,877,246 | 10/1989 | Kropkowski | 273/144 R |
| 5,062,635 | 11/1991 | Tse et al. | 273/144 A |
| 5,435,556 | 7/1995 | Rice et al. | 273/144 B |

FOREIGN PATENT DOCUMENTS

| | | | |
|---|---|---|---|
| 1122421 | 1/1962 | Germany | 273/144 B |
| WO8400115 | 1/1984 | WIPO | 273/144 B |

*Primary Examiner*—Benjamin H. Layno
*Attorney, Agent, or Firm*—Amster, Rothstein & Ebenstein

[57] ABSTRACT

A handheld character selector and display device for the agitation, random selection and display of spherical objects bearing characters thereon includes a main housing having disposed therein for random mixing through agitation a plurality of spherical objects bearing characters thereon. A sub-housing, preferably substantially smaller in volume than the main housing, is in communication with the main housing for receiving from the main housing for kinetic energy dissipation a sub-plurality of the spherical objects. A transparent identification chute, preferably substantially smaller in diameter than the sub-housing, is in communication with the sub-housing for receiving from the sub-housing and displaying in alignment a predetermined number of the spherical objects. Agitation means are provided for agitating the spherical objects in the main housing and propelling a sub-plurality thereof into the sub-housing so that the predetermined number of the spherical objects are eventually received in the chute, all within predetermined time constraints.

9 Claims, 3 Drawing Sheets

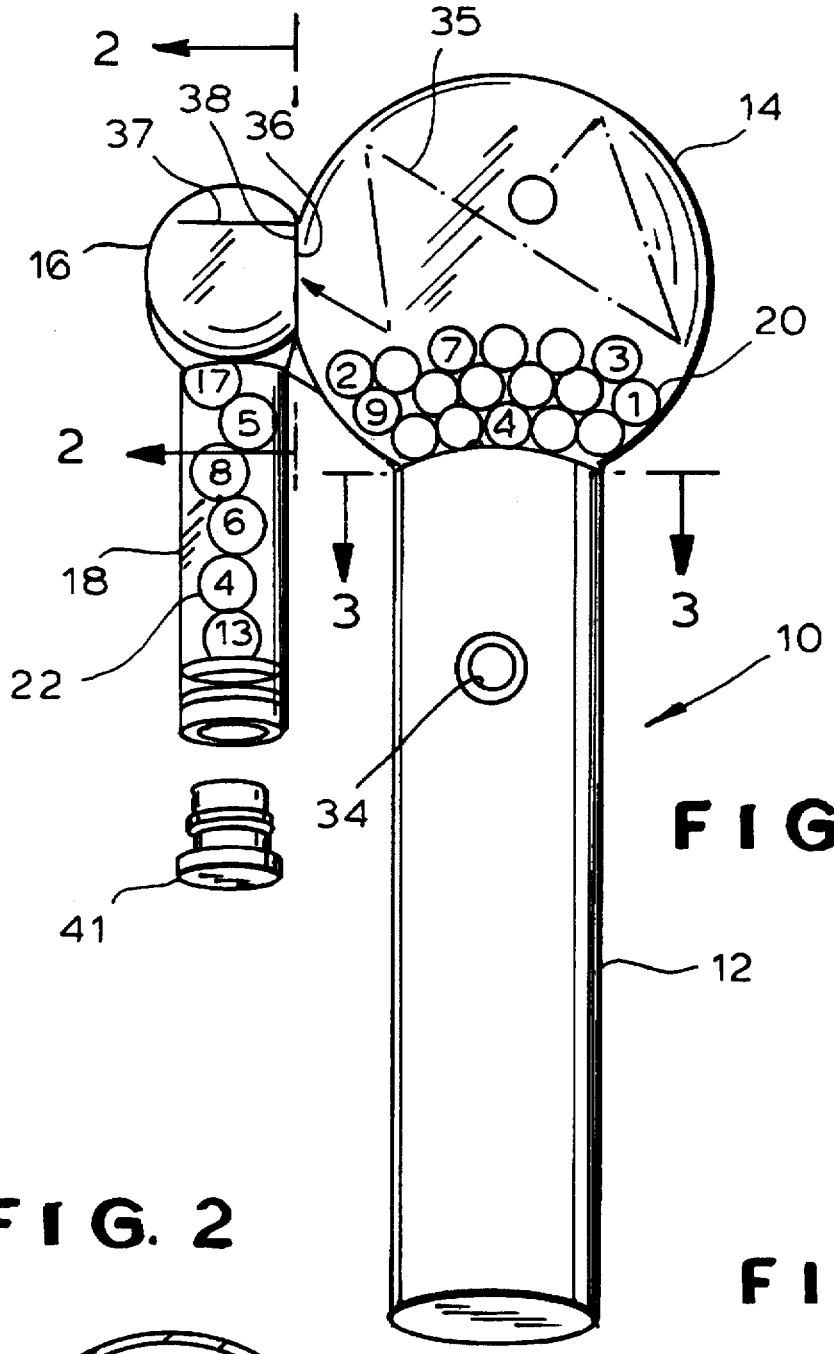
FIG. 1
FIG. 2
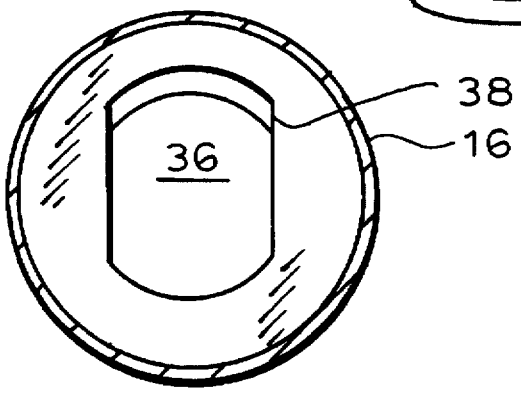
FIG. 3
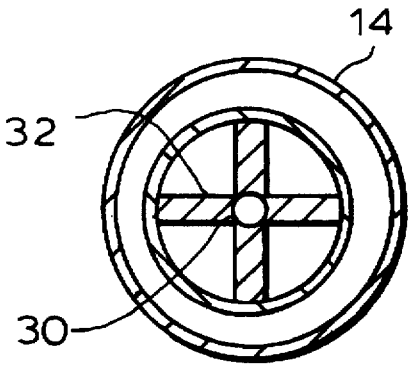

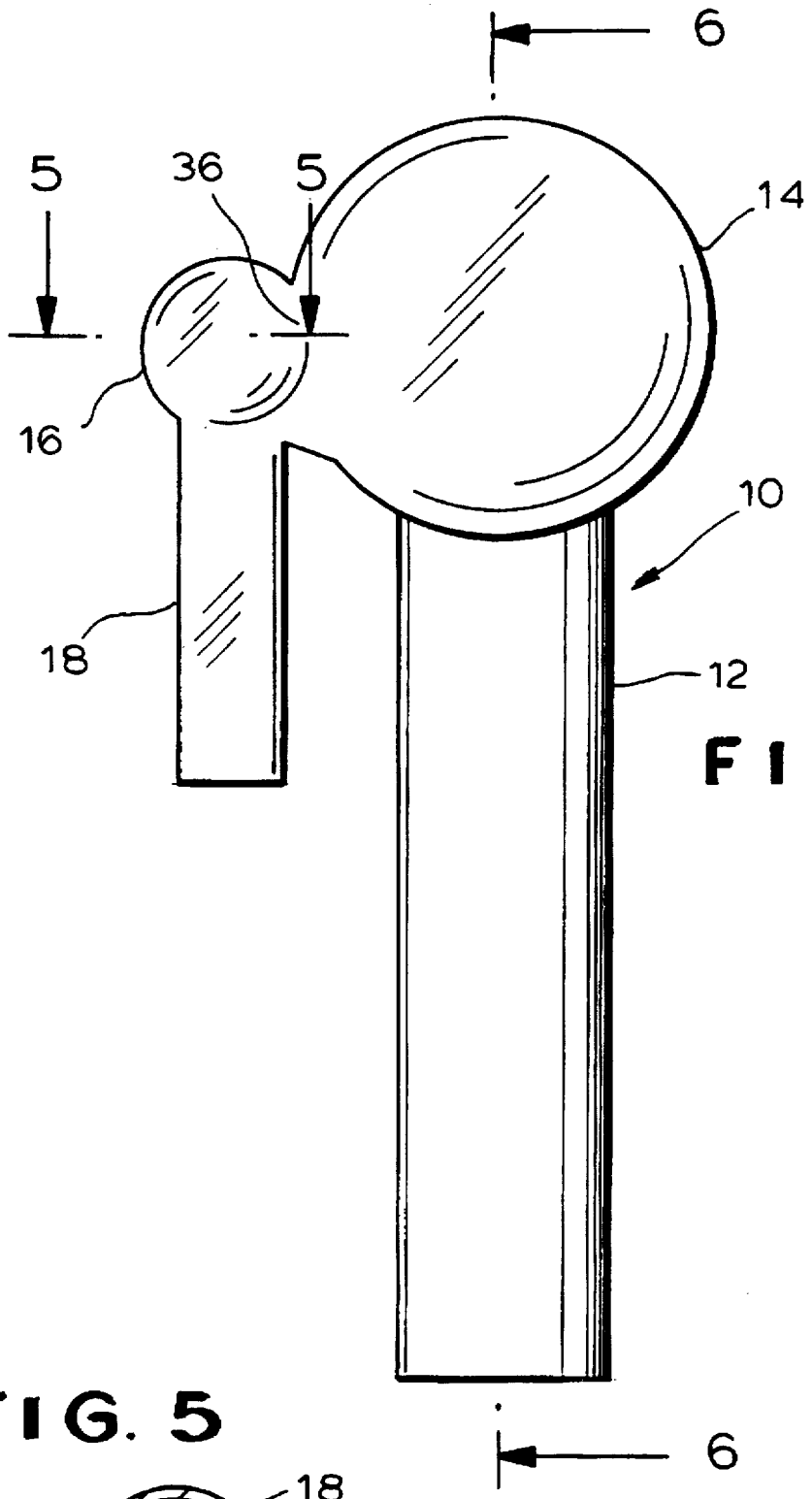
FIG. 4
FIG. 5
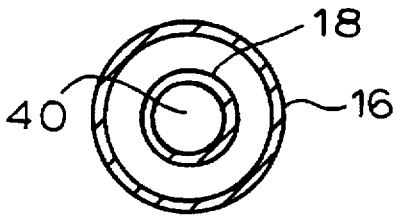

HANDHELD GAMING BALL DISPLAY DEVICE

CROSS-REFERENCE TO RELATED APPLICATION

This application claims the priority of U.S. Provisional application Ser. No. 60/011,630, filed Feb. 14, 1996.

BACKGROUND OF THE INVENTION

The present invention relates to a novelty device and, more specifically, to a handheld novelty device for the agitation, random selection, and display of spherical objects bearing written characters on the surface thereof (e.g., gaming balls), such device having particular application to games of chance and the like.

Devices which mix a multiplicity of spherical objects that have alphanumeric characters or other characters (hereinafter collectively called "character") printed on the surfaces thereof and then display a randomly selected but predetermined number of the objects to provide a sequence of characters are well known. For example, U.S. Pat. No. 3,468,542 has a rotatable spherical and transparent drum that has a door leading to a dispensing device. The drum houses a multiplicity of spherical objects, each having characters printed thereupon. Selected objects are then viewed in individual dispensing housings providing a sequence of characters. U.S. Pat. No. 4,280,702 discloses a gambling aid device having a hollow spherical member housing a plurality of spherical objects, each having characters printed on the surface. Connected to the device is a chute with a transition member. When the device is manually agitated, a select number of the spherical objects move through the transition member into the chute. The transition member serves as an entry point for additional or replacement spheres once the chute is rotated to open the transition member into the spherical member. The device clearly does not provide continuous high energy agitation to the spherical object, and the transition member does not collect more than one spherical member at a time. Additionally, U.S. Pat. No. 5,062,635 discloses a spherical housing connected directly to a display chute with a variable shutter between the chute and housing, whereby the opening into the chute can be varied in size as desired. The device has an electromagnet that can be used to influence the probability of selection of certain of the balls.

It is clear from the representative prior art above that none of the prior art devices provide for handheld display devices for spherical objects (hereinafter known as "balls") in which the character-bearing balls are automatically energized into a randomly moving pattern. Moreover, none appear to present the structure necessary to ensure that the display balls appear in sequence within certain desired time constraints.

Accordingly, it is an object of the present invention to provide a handheld display device for character-bearing balls in which the balls are automatically energized into a randomly moving pattern.

Another object is to provide such device where a predetermined number of the objects are received in a chute for display of the characters on the balls in sequence.

A further object is to provide such a device which ensures that the objects appear in sequence in the chute within certain desired time constraints.

SUMMARY OF THE INVENTION

It has now been found that the above and related objects to the present invention are obtained in a handheld character selector and display device for the agitation, random selection and display of spherical objects bearing characters thereon includes a main housing having disposed therein for random mixing through agitation a plurality of spherical objects bearing characters thereon (e.g., gaming balls). A sub-housing is in communication with the main housing for receiving from the main housing for kinetic energy dissipation a sub-plurality of the spherical objects. A transparent identification chute is in communication with the sub-housing for receiving from the sub-housing and displaying in alignment a predetermined number of the spherical objects. Agitation means are provided for agitating the spherical objects in the main housing and propelling a sub-plurality thereof into the sub-housing so that the predetermined number of the spherical objects are eventually received in the chute, all within predetermined time constraints.

In a preferred embodiment the agitation means includes a battery, an actuatable battery-operated motor, and a motor-driven agitator. The agitator is rotated by the motor, when actuated, and directly physically impinges on the spherical objects in the main housing. Alternatively, the agitator drives an agitating column of air into the main body. Preferably both the main housing and the sub-housing are transparent, but the sub-housing is substantially smaller in volume than the main housing, and the chute is substantially smaller in diameter than the sub-housing. Control means are provided for controlling actuation of the motor.

Preferably the device includes means for closing the free end of the chute, the closing means being removable to enable changing the number of spherical objects in the device.

BRIEF DESCRIPTION OF THE DRAWING

The above and related objects, features and advantages of the present invention will be more fully understood by reference to the following detailed description of the presently preferred, albeit illustrative, embodiments thereof when taken in conjunction with the accompanying drawing wherein:

FIG. 1 is a partially exploded perspective view of a handheld ball displaying device in accordance with the present invention;

FIG. 2 is a sectional view thereof, to an enlarged scale, taken along the line 2—2 of FIG. 1;

FIG. 3 is a sectional view thereof, taken along the line 3—3 of FIG. 1;

FIG. 4 is a side elevational view of the handheld ball displaying device in accordance with the present invention;

FIG. 5 is a sectional view taken along the line 5—5 of FIG. 4;

DETAILED DESCRIPTION OF THE PREFERRED EMBODIMENTS

Figure 6:
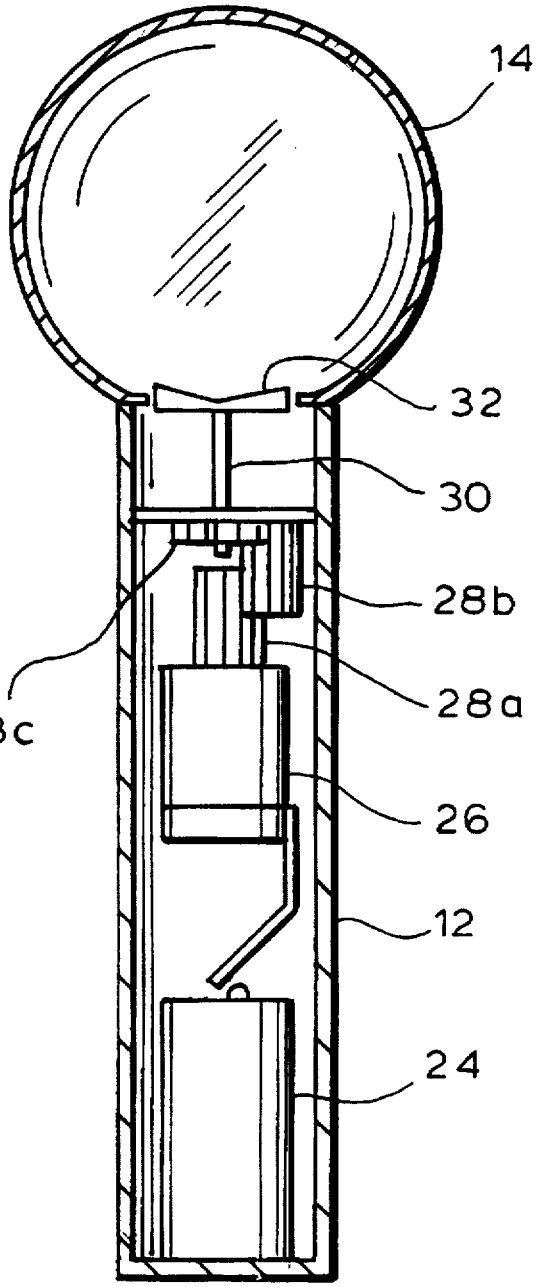
FIG. 6 is a view, partially in section, taken along the line 6—6 of FIG. 4.
Figure 7:
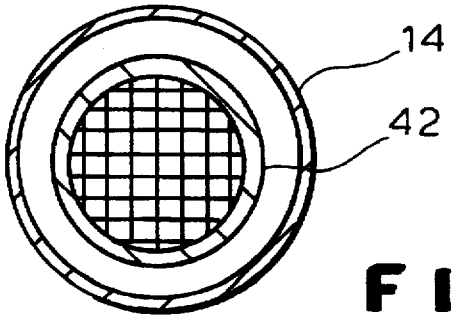
FIG. 7 is a sectional view, like FIG. 3, but showing an alternative construction for air pulse entry into the housing to agitate the balls.

Referring now to the drawing, and in particular to FIG. 1 thereof, the handheld gaming ball display device of the present invention, generally designated by the reference numeral 10, generally comprises four major components: a motor and battery container 12, a main ball display housing 14, a sub-housing 16, and a ball identification chute 18. The spherical main display housing 14 contains a group of balls 20, each bearing characters in various locations on the surface thereof. The container 12 encloses agitation means, that is, the elements used to agitate the balls 20 in the main housing 14, while the sub-housing 16 serves to "capture" certain of the agitated balls 20, thereafter allowing a number of them to fall into the chute 18 as the winning character identification balls 22 as they lose or dissipate the kinetic energy (directly or indirectly) imparted to them by the agitation means.

Container 12, made preferably of a dense plastic material, is integrally connected to the base of housing 14 and is preferably non-transparent. As best seen in FIG. 6, container 12 contains a battery 24 electrically connected to a motor 26. Motor 26, through a series of interconnected gears 28*a*, 28*b*, and 28*c*, rotatably drives a shaft 30 connected to an agitator member 32 positioned in the bottom of main housing 14. As is illustrated in FIG. 3 and 4, the agitator member 32 has a circular base that is complimentary to housing 14. When on/off button 34 (see FIG. 1) is held in a depressed state, it causes an electric circuit between battery 24 and motor 26, motor 26 is energized, and agitator member 32 is rotated, thereby causing each of the balls 20 to energetically and randomly fly about within housing 14 as illustrated by the illustrative path 35 (see FIG. 1).

Sub-housing 16, preferably fabricated from the same transparent material as main housing 14, is preferably flat relative to the main housing 14 and circular. It communicates with housing 14 through an opening 36. Opening 36 is collectively defined by the intersection of sub-housing 16 with housing 14 and a ramp 38 extending downwardly from the top of the intersection to limit the size of opening 36, as perhaps best illustrated in FIG. 2. Preferably sub-housing 16 is substantially smaller in volume and diameter than main housing 14 and has an interior depth slightly greater than the diameter of balls 20.

Chute 18 is comprised of a transparent material, preferably the same material as housing 14 and sub-housing 16. It is cylindrical in shape and is connected to the bottom of sub-housing 16, communicating with the interior of the sub-housing 16 through an opening 40 at one end, the other end being closed. The interior diameter of chute 18 is slightly greater than the diameter of balls 20. Ramp 38 is inclined downwardly from the top of opening 36 so that, when the device 10 is in a substantially vertical position, once chute 18 is filled with balls 22 and motor 26 is de-energized, sub-housing 16 tends to empty itself of additional balls 20, at least when shaken horizontally.

The number of balls used will vary with the application. For example, when used to replicate the sequence of characters used in "lotto" type games, such as presently being played within the various states of the United States, the number of balls selected range between five and six. Some states use five balls for a sequence of five characters, while most others require six. As shown in FIG. 1, the chute 18 has a length and an interior volume sufficient to house six balls in vertical alignment. However, it is to be understood that the width of the chute 18 is primarily based upon the diameter of the balls used, and the length thereof is solely based on the number of balls 22 required for the identifying sequence of characters. Preferably the chute diameter is substantially less than the sub-housing diameter.

As earlier noted, the opening 40 at one end of chute 18 communicates with sub-housing 16, while the other end is closed. The other end of chute 18 may be permanently sealed, and the balls 20 inserted into main housing 14 prior to attachment of the container 12 thereto. Alternatively, a removable closure means 41 with an external circumferential groove designed to releasably snap into an internal circumferential groove at the other end of chute 18 (see FIG. 1) may be provided, thereby to enable the number of balls 20 in the device to be changed by the user according to the number of balls used in the particular lottery game to be played. Of course, the balls 20 to be retained would be those bearing the characters (or numbers) found in the particular lottery game to be played. If desired, the balls 20 initially placed in the device may be inserted through the chute 18 before the closure means 41 is applied thereto.

Preferably the closure means 41 can assume two distinct positions, each closing the free end of chute 18. To this end, the chute free end preferably defines two axially spaced internal circumferential grooves, each capable of receiving the external circumferential groove of the closure means 41. In the first or normal position, the closure means 41 is inserted as far as possible into chute 18 (so its groove enters the upper chute groove) and is difficult to remove therefrom. In the alternative position, the closure means 41 is only loosely inserted into the free end of chute 18 (so its groove enters the lower chute groove) and is easy to remove from chute 18 for replacement of the balls by the purchaser of the device. Once the purchaser has made any necessary adjustments in the number of balls 20, he snaps the closure means 41 all the way into place, where it will remain unless forcibly removed therefrom at a later date. Thus, in the preferred embodiment, the present invention enables a home "custom tailoring" of the device to meet the particular character of the game to be played.

Naturally, if a game requires a fewer number of characters (relative to the capacity of the chute 18) to constitute a winner, only the first ball of the first plurality of balls in the chute is considered in determining the winner. Indeed, if desired, the device may be supplied with a variety of different lengths closure means 41, one allowing the chute 18 to contain the full load (e.g., six balls), while others progressively diminish the number of balls which the chute can accommodate.

If a secondary character is used to determine a winner of the game, that secondary character may be determined by the position of the agitator member 32 when rotation thereof is ceased. For example, the outer circumference of the agitator member 32 disposed in the top of the container 12 may bear thereon a series of characters, and the container 12 may bear a transparent viewing window enabling only an aligned character to be viewed through the viewing window. Thus, when the agitator member 32 has ceased rotation, the secondary character will be determined by the character visible through the viewing window.

One significant function of the sub-housing 16 is to ameliorate or reduce the kinetic energy of the randomly moving balls 20 that enter into the interior thereof through opening 36 so that the predetermined number of balls can fall through opening 40 into chute 18 in a minimal amount of time. Without a sub-housing that provides this function, it is difficult to get the energetically bouncing balls to enter the chute 18 within an acceptable period of time without reducing the size of the balls considerably relative to the chute diameter (and thereby reducing the maximum possible character size). Thus, it has been determined that the ratio of the volume of the sub-housing and the opening 36 to the diameter of the balls 20 are important contributors to the proper functioning of the device 10. To this end, it is noted that, for certain small volumes of sub-housing 16, the time taken for chute 18 to be completely filled with balls 20 becomes much larger than is acceptable. Additionally, it is believed that it is more pleasing to users when the balls 20 fall into chute 18 at an average rate of not less than about one ball per second, thus filling the chute 18 in about six seconds when the required number of balls is six. This time interval provides an opportunity to recognize the number written on each ball as it enters the chute and, perhaps, record such number elsewhere before the next ball has entered into the chute 18. On the other hand, exceeding about 2 seconds per ball renders the device impractical for its intended use since the total time taken to fill the chute becomes too long. To obtain the desired rate, the volume of the sub-housing should allow at least three balls, and preferably 3–5 balls, to be housed within sub-housing 16 at any one time. While it is clear that the diameter of the opening 36 must be larger than the diameter of the balls, this ratio should be at least 1.25, preferably between about 1.5–2.0, in order that the time taken for chute 18 to fill with balls 20 is about 5 to 10 seconds.

A baffle 37, as depicted in FIG. 1, may be used within sub-housing 16 to alter the volume thereof, thus changing both the number of balls that can be enclosed thereby simultaneously and the rate at which the balls enter the chute 18. The use of a baffle 37 allows the manufacture of a standard size sub-housing 16 for varying applications where the desired time interval may be different. By providing sub-housing 16 with a baffle 37, the effective volume of the sub-housing 16 for receiving the balls is decreased, and thus the time interval required to fill the chute 18 is increased.

While the preferred embodiment, as illustrated in FIG. 3, discloses a rotating agitator member 32 to provide for the random movement of the balls 20 within the housing 14, other and different techniques of agitation could be used. As shown in FIG. 6, the bottom of housing 14 could be a screen 42 allowing the motor to drive pulses of air upwardly into the interior of housing 14, thereby providing the energy needed to place balls 20 into random motion. Alternatively, other techniques such as a fluttering diaphragm powered by electromagnetics could be employed.

By way of example, in a preferred embodiment, the ball has an outside diameter of about 0.295", the housing has an inside diameter of about 2.5" (and a volume of about 4.98 cu. in.), the sub-housing has an inside diameter of about 0.875" (and a volume of about 0.3 cu. in.), the chute has an inside diameter of about 0.375", and the opening is about 1.5" long. The housing:sub-housing volumetric ratio is preferably 16:1.

To summarize, the present invention provides a handheld display device for character-bearing objects which are automatically energized into a moving pattern, the display balls appearing in sequence in a transparent chute within certain time constraints.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A handheld character selector and display device for the agitation, random selection and display of spherical objects bearing characters thereon, said device comprising:

(A) a main housing having disposed therein for random mixing through agitation a plurality of spherical objects bearing characters thereon;

(B) a sub-housing substantially smaller in volume than said main housing and in communication with said main housing for receiving from said main housing for kinetic energy dissipation a sub-plurality of said spherical objects;

(C) a transparent identification chute substantially smaller in diameter than said sub-housing and in communication with said sub-housing for receiving from said sub-housing and displaying in alignment a predetermined number of said spherical objects; and (D) agitation means for agitating said spherical objects in said main housing and propelling a sub-plurality thereof into said sub-housing so that said predetermined number of said spherical objects are eventually received in said chute, all within predetermined time constraints;

said sub-housing being configured and dimensioned to allow said predetermined number of said spherical objects to be received therefrom by said chute even while and if said agitation means is continuously agitating and propelling.

2. The device of claim 1 wherein said agitation means includes a battery, an actuatable battery-operated motor, and a motor-driven agitator.

3. The device of claim 2 wherein said agitator is rotated by said motor, when actuated, and directly physically impinges on said spherical objects in said main housing.

4. The device of claim 2 wherein said agitator drives an agitating column of air into said main body.

5. The device of claim 1 wherein said main housing and said sub-housing are transparent.

6. The device of claim 1 wherein said sub-housing is substantially smaller in volume than said main housing and of greater diameter than said chute.

7. The device of claim 1 additionally including control means for controlling actuation of said motor.

8. The device of claim 1 wherein the free end of said chute is closed by a removable closure means, said removable closure means being removable to enable said plurality of changing of said spherical objects in said device.

9. A handheld character selector and display device for the agitation, random selection and display of spherical objects bearing characters thereon, said device comprising:

(A) a transparent main housing having disposed therein for random mixing through agitation a plurality of spherical objects bearing characters thereon;

(B) a transparent sub-housing substantially smaller in volume than said main housing and in communication with said main housing for receiving from said main housing for kinetic energy dissipation a sub-plurality of said spherical objects;

(C) a transparent identification chute substantially smaller in diameter than said sub-housing and in communication with said sub-housing for receiving from said sub-housing and displaying in alignment a predetermined number of said spherical objects;

(D) agitation means for agitating said spherical objects in said main housing and propelling a sub-plurality thereof into said sub-housing so that said predetermined number of said spherical objects are eventually received in said chute, all within predetermined time constraints, said agitation means including a battery, an actuatable battery-operated motor, and a motor-driven agitator, said agitator being rotated by said motor, when actuated, and directly physically impinging on said spherical objects in said main housing; and (E) control means for controlling actuation of said motor;

said sub-housing being configured and dimensioned to allow said predetermined number of said spherical objects to be received therefrom by said chute even while and if said agitation means is continuously agitating and propelling.

* * * * *